US007382990B2

(12) United States Patent
Park et al.

(10) Patent No.: US 7,382,990 B2
(45) **Date of Patent: *Jun. 3, 2008**

(54) IMAGE FORMING APPARATUS

(75) Inventors: Sang-cheol Park, Suwon-si (KR); Young-min Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/353,950

(22) Filed: Feb. 15, 2006

(65) Prior Publication Data

US 2006/0227693 A1 Oct. 12, 2006

(30) Foreign Application Priority Data

Feb. 18, 2005 (KR) ..... 10-2005-0013518

(51) Int. Cl.
*G03G 15/00* (2006.01)

(52) U.S. Cl. ..... 399/24; 399/12

(58) Field of Classification Search ..... 399/12, 399/24, 25, 27, 110, 111, 119, 122, 393
See application file for complete search history.

(56) References Cited

U.S. PATENT DOCUMENTS

| | | | | |
|---|---|---|---|---|
| 6,121,988 | A * | 9/2000 | Uchiyama | 347/208 |
| 6,377,764 | B1 | 4/2002 | Morris-jones | |
| 6,393,249 | B1 * | 5/2002 | Aslam et al. | 399/24 X |
| 6,490,422 | B2 * | 12/2002 | Harumoto | 399/27 |
| 6,704,521 | B2 * | 3/2004 | Isobe et al. | 399/12 |
| 6,808,255 | B1 * | 10/2004 | Haines et al. | 399/12 X |
| 6,863,364 | B2 * | 3/2005 | Russell et al. | 399/24 X |
| 7,177,553 | B2 * | 2/2007 | Ono | 399/12 |
| 2002/0094207 | A1 | 7/2002 | Richards et al. | |
| 2003/0081021 | A1 | 5/2003 | Zaremba | |
| 2005/0191064 | A1 * | 9/2005 | Park et al. | 399/12 |
| 2006/0029399 | A1 * | 2/2006 | Park et al. | 399/12 |

FOREIGN PATENT DOCUMENTS

| | | |
|---|---|---|
| JP | 4-265780 | 9/1992 |
| JP | 11-338329 | 12/1999 |
| JP | 2002-296984 | 10/2002 |
| KR | 2004-14920 | 2/2004 |
| KR | 2004-20173 | 3/2004 |
| KR | CN 1484187 A | 3/2004 |
| KR | 2004-54715 | 6/2004 |

OTHER PUBLICATIONS

Office Action Issued on Dec. 7, 2007 by the Chinese Intellectual Property Office for Chinese Patent Application No. 200610059983.1.

* cited by examiner

*Primary Examiner*—Sandra L Brase
(74) *Attorney, Agent, or Firm*—Stein, McEwen & Bui, LLP

(57) ABSTRACT

An image forming apparatus includes at least two radio frequency identification (RFID) tags, an interrogator activating the RFID tags and sequentially receives tag information from the RFID tags according to the priority orders of the RFID tags, and a controller controlling the operation of the interrogator. Tag information of a plurality of RFID tags can be received by a single reader (interrogator). In other words, radio communication can be achieved without a plurality of readers, thereby reducing the material costs.

22 Claims, 3 Drawing Sheets

IMAGE FORMING APPARATUS

CROSS-REFERENCE TO RELATED APPLICATIONS

This application claims the benefit of Korean Patent Application No. 2005-13518, filed on Feb. 18, 2005, in the Korean Intellectual Property Office, the disclosure of which is incorporated herein in its entirety by reference.

BACKGROUND OF THE INVENTION

1. Field of the Invention

Aspects of present invention relate to an image forming apparatus, and more particularly, to an image forming apparatus that includes a plurality of radio frequency identification (RFID) tags and in which tag information of the plurality of RFID tags can be processed using a single reader interrogator.

2. Description of the Related Art

In an image forming apparatus, such as, for example, a laser printer, photocopier, or facsimile printer, it may be desirable to obtain or process identification data or operational data regarding the apparatus.

Accordingly, an image forming apparatus may be equipped with a radio communication system that can read and write information regarding the image forming apparatus. A radio communication system may include a radio frequency identification (RFID) tag, a reader capable of communicating with the RFID tag via radio waves, and a controller controlling the RFID tag and the reader.

Since information can be transmitted in an image forming apparatus through radio communication without using connection terminals, etc., the structure of an image forming apparatus can be simplified, in comparison, for example, to an apparatus in which information is transmitted through wires.

However, currently available communication techniques using radio frequency identification typically enable only one-to-one communication between a reader and an RFID tag. This creates a disadvantage in an image forming apparatus that uses a plurality of RFID tags, since a plurality of readers, equal to the number of RFIDs, are required, thereby increasing the material costs and the design complexity.

SUMMARY OF THE INVENTION

An aspect of the present invention provides an image forming apparatus in which tag information transmitted from a plurality of radio frequency identification (RFID) tags can be received by a single reader.

Additional aspects and/or advantages of the invention will be set forth in part in the description which follows and, in part, will be obvious from the description, or may be learned by practice of the invention.

According to an aspect of the present invention, there is provided an image forming apparatus comprising: at least two RFID tags; an interrogator activating the RFID tags and sequentially receiving tag information of the RFID tags according to the priority orders of the RFID tags; and a controller controlling the operation of the interrogator.

According to another aspect of the present invention, there is provided a system that processes identification data and/or operational data in an image forming apparatus including at least two RFID tags, each RFID tag providing at least one of identification data or operational data of the image forming apparatus, an interrogator activating the RFID tags and sequentially receiving tag information of the RFID tags according to the priority orders of the RFID tags; and a controller controlling the operation of the interrogator.

According to another aspect of the present invention, there is provided an image forming apparatus that includes at least a developing unit, a laser scanning unit, a paper supply unit and a system that processes identification data and/or operational data in an image forming apparatus including at least two RFID tags, each RFID tag providing at least one of identification data or operational data of the image forming apparatus, an interrogator activating the RFID tags and sequentially receiving tag information of the RFID tags according to the priority orders of the RFID tags; and a controller controlling the operation of the interrogator.

According to another aspect of the present invention, there is provided an image-forming apparatus comprising: a developing unit; a fusing unit; a laser scanning unit; a paper supply unit including a paper cartridge; at least two RFID tags selected from the following: a read/write RFID tag that records and provides information regarding an amount of toner remaining in the developing unit and/or a remaining life span of the developing unit, a read/write RFID tag that records and provides information regarding a remaining life span of the fusing unit, a read only RFID tag that provides stored prerecorded information regarding the laser scanning unit, a read only RFID tag that is attached to the paper cartridge and provides prerecorded information regarding a type of the paper cartridge and a read only RFID tag that provides information required for logistics management including at least one of a model name, a manufacturing date, a manufacturer, or a serial number of the image forming apparatus, an interrogator activating the RFID tags and sequentially receiving tag information of the RFID tags; and a controller that controls operation of the interrogator.

According to another aspect of the present invention, there is provided an image forming apparatus comprising at least two RFID tags, each RFID tag providing at least one of identification data or operational data of the image forming apparatus; a single interrogator activating the RFID tags and receiving tag information of the RFID tags.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
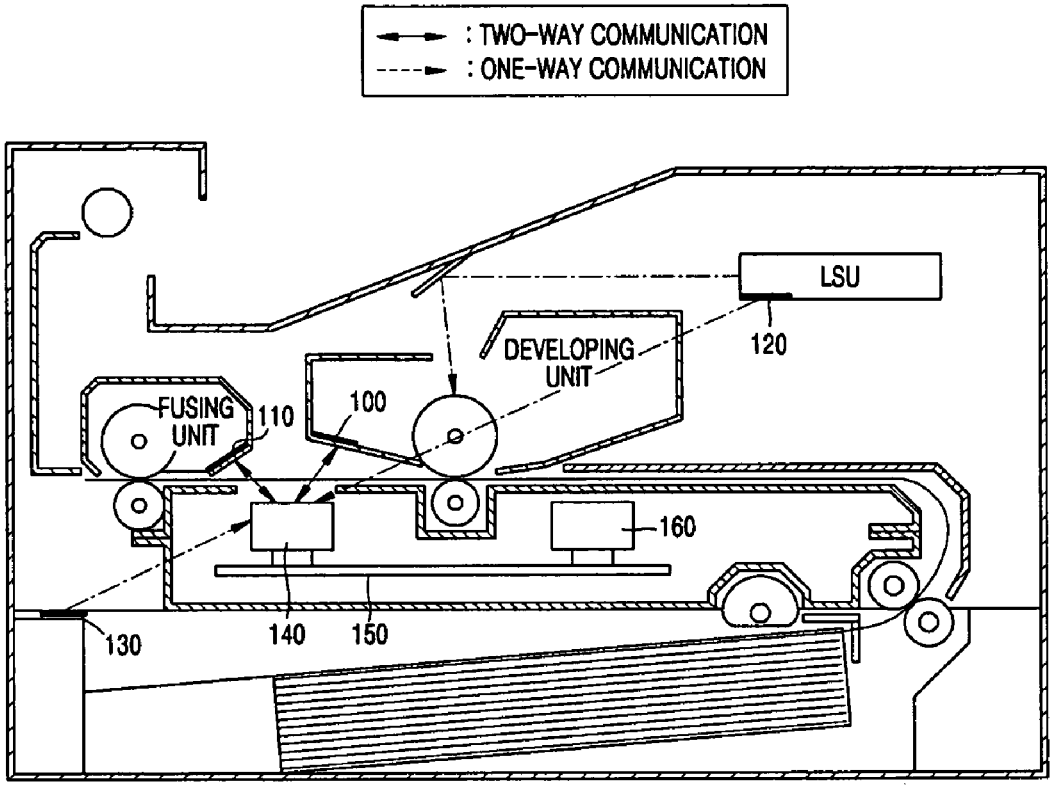
FIG. 1 is a side cross-sectional schematic view of an image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

RFID is an automatic identification technology using radio frequencies and is a representative technology using non-contact type cards that can replace barcodes and magnetic cards. A low frequency band ranging from 125 kHz to 400 kHz is used for short-distance transmission, and a typical reader's transmitting frequency usually ranges from 125 kHz to 2.4 GHz. Recently, a high frequency band ranging from 4 MHz to 20 MHz and a microwave frequency band of 2.45 GHz have been used, and a frequency band of 13.56 MHz is becoming the standard frequency for RFID.

FIG. 1 is a side cross-sectional schematic view of an image forming apparatus according to an embodiment of the present invention. Referring to FIG. 1, an image forming apparatus may include a first radio frequency identification (RFID) tag 100, a second RFID tag 110, a third RFID tag 120, a fourth RFID tag 130, an interrogator 140, a mainboard 150, and a controller 160. These features are in addition to conventional features of an image forming apparatus shown in FIG. 1, which are clearly understood in the art and are not separately described. For example, as identified in FIG. 1, the image forming apparatus may include a fusing unit, developing unit and laser scanning unit.

Each of the first through fourth RFID tags 100, 110, 120, and 130 may include a transmission antenna (not shown) for transmit tag information and a memory (not shown) storing the tag information. In particular, the first through fourth RFID tags 100, 110, 120, and 130 may include a non-volatile memory that can stably store information for a long time without a power supply. For example, each of the first through fourth RFID tags 100, 110, 120, and 130 may include an electrically erasable and programmable read only memory (EEPROM).

When the interrogator 140 radiates radio waves, the first through fourth RFID tags 100, 110,120, and 130 enter a magnetic field and are activated to transmit their tag information to the interrogator 140.

The first through fourth RFID tags 100, 110, 120, and 130 may be placed at locations where they can communicate with the interrogator 140 via radio waves.

The first RFID tag 100 is attached to a developing unit and may store information regarding the quantity of toner remaining in the developing unit, the life span of the developing unit, or the like.

The second RFID tag 110 is attached to a fusing unit and may store information regarding the life span of the fusing unit or the like.

The third RFID tag 120 is attached to a laser scanning unit (LSU) and may store information regarding the life span of the LSU, the laser intensity of the LSU, or the like.

The fourth RFID tag 130 is attached to a paper cartridge and stores information regarding the type of the paper cartridge or the like.

The first through fourth RFID tags 100, 110, 120, and 130 may include information regarding their priorty orders. That is, the first through fourth RFID tags 100, 110, 120, and 130 may communicate via radio waves with the interrogator 140 in a predetermined order. Table 1 shows exemplary priority orders of the first through fourth RFID tags 100, 110, 120, and 130.

TABLE 1

| RFID tag | Priority order |
|---|---|
| First RFID tag | 1 |
| second RFID tag | 2 |

TABLE 1-continued

| RFID tag | Priority order |
|---|---|
| Third RFID tag | 4 |
| fourth RFID tag | 3 |

According to the priority orders in Table 1, the first RFID tag 100 with the first priority order sends its tag information to the interrogator 140, the second RFID tag 110 with the second priority order sends its tag information to the interrogator 140, the fourth RFID tag 130 with the third priority order sends its tag information to the interrogator 140, and the third RFID tag 120 with the fourth priority order sends its tag information to the interrogator 140. The radio communication between the interrogator 140 and each of the first through fourth RFID tags 100, 110, 120, and 130 may be repeated at a regular interval.

The first through fourth RFID tags 100, 110, 120, and 130 may be constructed so that they can be easily detached from and/or attached to the image forming apparatus.

The first through fourth RFID tags 100, 110, 120, and 130 may include read only tags and read/write tags. That is, for example, the first and the second RFID tags 100 and 110 may be read/write tags, and the third and the fourth RFID tags may be read only tags.

The interrogator 140 activates the first through fourth RFID tags 100, 110, 120 and 130 and sequentially receives tag information from the first through fourth RFID tags 100, 110, 120 and 130 according to their priority orders. That is, as the interrogator 140 continuously radiates radio waves, the first through fourth RFID tags RFID tags 100, 110, 120 and 130 located within a communication distance of the interrogator 140 sequentially transmit their tag information to the interrogator 140 according to their priority orders.

The interrogator 140 receives tag information from one of the first through RFID tags 100, 110, 120, and 130 with the highest priority order and then sequentially receives tag information from the other RFID tags with lower priority orders. For example, according to the priority orders in Table 1, the first RFID tag 100 with the first priority order transmits its tag information to the interrogator 140, and the second RFID tag 110, the fourth RFID tag 130, and the third RFID tag 120 sequentially transmit their tag information to the interrogator 140.

The interrogator 140 outputs the tag information sequentially received from the first through fourth RFID tags 100, 110, 120, and 130 to the controller 160.

The interrogator 140 may be integrally formed with the mainboard 150. As a result, additional cables for connecting the interrogator 140 and the mainboard 150 are not required, thereby reducing the material costs and simplifying assembling processes.

A portion of the image forming apparatus in which the interrogator 140 is installed may be formed of a non-conductive material to allow noiseless radio communication between the interrogator 140 and the first through fourth RFID tags 100, 110, 120, and 130.

The controller 160 controls the operation of the interrogator 140. In particular, the controller 160 controls the interrogator 140 to allow that tag information is written in the first and the second RFID tags 100 and 110, which are read/write tags. The controller 160 receives the tag information of the first through fourth RFID tags 100, 110, 120, and 130 from the interrogator 140 and controls operations according to the tag information.

The controller 160 may be integrally formed with the mainboard 150. As a result, additional cables for connecting the interrogator 140 and the mainboard 150 are not required, thereby reducing the material costs and simplifying assembling processes.

Figure 2:
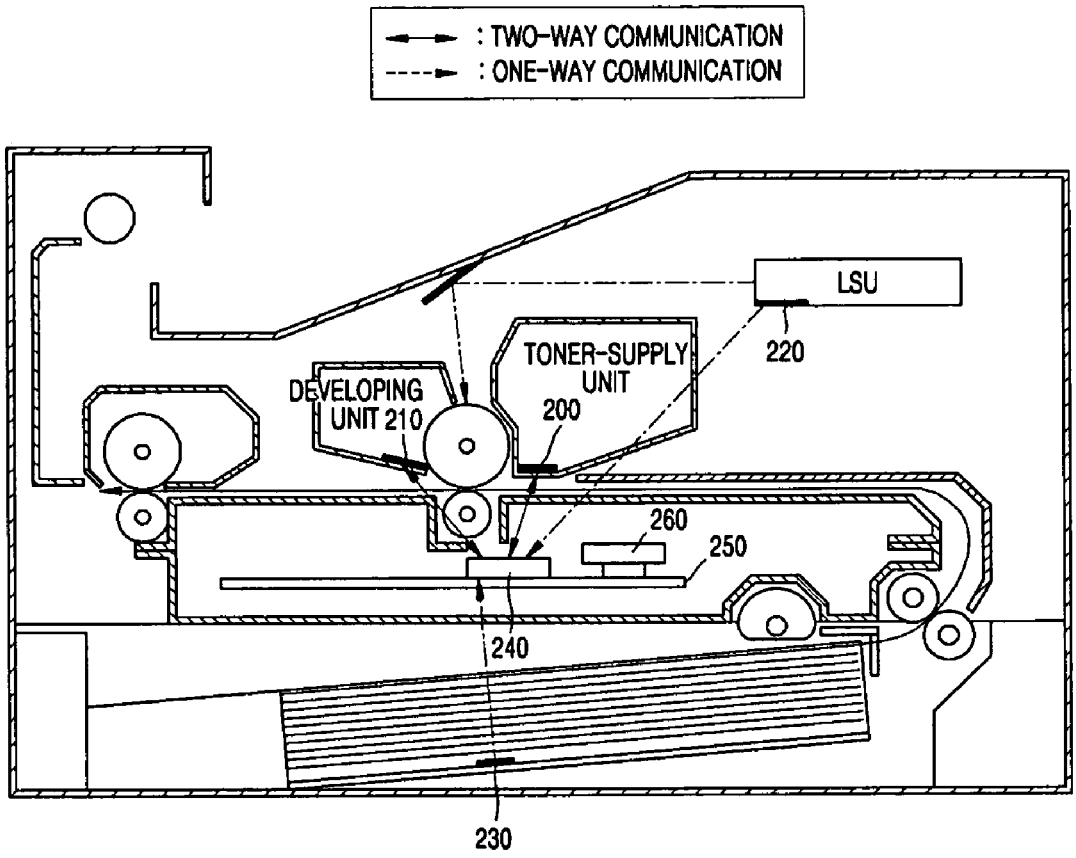
FIG. 2 is a side cross-sectional schematic view of an image forming apparatus according to another embodiment of the present invention.

FIG. 2 is a side cross-sectional schematic view of an image forming apparatus according to another embodiment of the present invention. Referring to FIG. 2, an image forming apparatus includes a first RFID tag 200, a second RFID tag 210, a third RFID tag 220, a fourth RFID tag 230, an interrogator 240, a mainboard 250, and a controller 260. The image forming apparatus has a structure in which a developing unit and a toner-supply unit containing toner are separately formed. The first RFID tag 200 and the second RFID tag 210 are respectively attached to the toner-supply unit and the developing unit. The first RFID tag 200 may store tag information regarding the quantity of toner remaining in the toner-supply unit, and the second RFID tag 210 may store tag information regarding the life span of the developing unit. Conventional features of an image scanning apparatus as shown in FIG. 2 are clearly understood in the art and are not separately described.

The first through fourth RFID tags 200, 210, 220, and 230, the interrogator 240, the mainboard 250, and the controller 260 respectively have the same functions as the first through fourth RFID tags 100, 110, 120, and 130, the interrogator 140, the mainboard 150, and the controller 160 in FIG. 1. Thus, descriptions thereof will not be repeated here.

Figure 3:
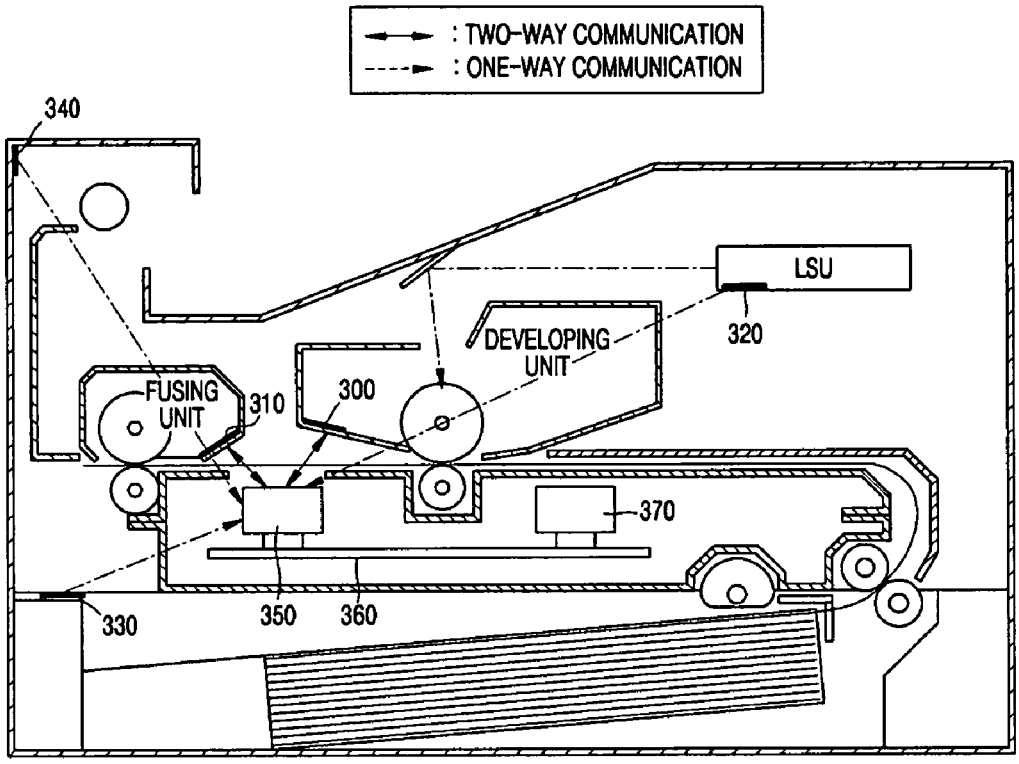
FIG. 3 is a side cross-sectional schematic view of an image forming apparatus according to another embodiment of the present invention.

FIG. 3 is a side view of an image forming apparatus according to another embodiment of the present invention. Referring to FIG. 3, an image forming apparatus includes a first RFID tag 300, a second RFID tag 310, a third RFID tag 320, a fourth RFID tag 330, a fifth RFID tag 340, an interrogator 350, a mainboard 360, and a controller 370. In the image forming apparatus of FIG. 3, the fifth RFID tag 340 is attached to a housing. The fifth RFID 340 tag may store information required for logistics management, such as model name, manufacturing date, manufacturer, serial number, etc. The information from the fifth RFID tag 340 may be transmitted to the controller 370 via the interrogator 350 for logistics management.

The first through fourth RFID tags 300, 310, 320, and 330, the interrogator 350, the mainboard 360, and the controller 370 respectively have the same functions as the first through fourth RFID tags 100, 110, 120, and 130, the interrogator 140, the mainboard 150, and the controller 160 in FIG. 1. Thus, descriptions thereof will not be repeated here. Conventional features of an image scanning apparatus shown in FIG. 3 are clearly understood in the art and are not separately described.

As described above, an image forming apparatus according to aspects of the present invention is designed such that radio frequency signals emitted from a plurality of RFID tags can be received through a single reader (interrogator). Accordingly, radio communication can be achieved without a plurality of readers, thereby reducing the material costs.

Although the above description refers to RFID tags having specific functions in specific locations in an image forming apparatus, it is to be understood that RFID tags can be placed in any useful location in an image forming apparatus for the purpose of transmitting any information desired by a user.

In addition, the RFID tags may be divided into read/write RFID tags and read only RFID tags, which can be selectively used according to a functional requirement.

When a RFID tag with logistics information is attached to an image forming apparatus, the efficiency of logistics management of the image forming apparatus can be increased.

Further, since the mainboard and the reader of the image forming apparatus are integrally formed, additional cables for connecting the reader and the mainboard are unnecessary, thereby reducing the material costs and simplifying assembling processes.

Further, since no connection cable is used, the generation of radiation noise from connection cables can be prevented.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

at least two RFID (radio frequency identification) tags;

an interrogator activating the RFID tags and sequentially receiving tag information of the RFID tags according to priority orders of the RFID tags; and a controller controlling the operation of the interrogator.

2. The image forming apparatus of claim 1, wherein the RFID tags are attached to locations where the RFID tags are communicable with the interrogator via radio waves.

3. The image forming apparatus of claim 1, wherein the RFID tags store information regarding the priority orders.

4. The image forming apparatus of claim 1, wherein the RFID tags are attachable to and detachable from the image forming apparatus.

5. The image forming apparatus of claim 1, wherein the RFID tags include at least one read only tag and at least one read/write tag.

6. The image forming apparatus of claim 1wherein each of the RFID tags includes non-volatile memory.

7. The image forming apparatus of claim 1, wherein the interrogator receives the tag information from one of the RFID tags with the highest priority order and then receives tag information from another RFID tag with a lower priority order.

8. The image forming apparatus of claim 1, further comprising a mainboard and wherein the interrogator is integrally formed with the main board.

9. The image forming apparatus of claim 1, wherein a portion of the image forming apparatus in which the interrogator is installed is formed of a non-conductive material.

10. The image forming apparatus of claim 1, further comprising a mainboard and wherein the controller is integrally formed with the main board.

11. A system that processes identification data and/or operational data in an image forming apparatus, the system comprising at least two RFID (radio frequency identification) tags, each RFID tag providing at least one of identification data or operational data of the image forming apparatus;

an interrogator activating the RFID tags and sequentially receiving tag information of the RFID tags according to priority orders of the RFID tags; and a controller controlling the operation of the interrogator.

12. The system of claim 11, wherein the image forming apparatus includes a toner supply unit and wherein the system includes a read/write RFID tag that records and provides information regarding an amount of toner remaining in the toner supply unit.

13. The system of claim 11, wherein the image forming apparatus includes a developing unit and wherein the system includes a read/write RFID tag that records, stores and provides information regarding an amount of toner remaining in the developing unit and/or a remaining life span of the developing unit.

14. The system of claim 11, wherein the image forming apparatus includes a fusing unit and wherein the system includes a read/write RFID tag that records and provides information regarding a remaining life span of the fusing unit.

15. The system of claim 11, wherein the image forming apparatus includes a laser scanning unit and wherein the system includes a read/write RFID tag that records, stores and provides information regarding a laser intensity and/or a remaining life span of the laser scanning unit or a read only RFID that provides stored prerecorded information regarding the laser scanning unit.

16. The system of claim 11, wherein the image forming apparatus includes a paper supply unit and wherein the system includes a read/write RFID tag that records, stores and provides information regarding an amount of paper remaining in the paper supply unit and/or a type of paper contained in the paper supply unit or a read only RFID tag that is attached to a paper cartridge of the paper supply unit and provides prerecorded information regarding the type of the paper cartridge.

17. The system of claim 11, wherein the system includes a read only RFID tag that provides information required for logistics management including at least one of a model name, a manufacturing date, a manufacturer, or a serial number of the image forming apparatus.

18. An image-forming apparatus comprising at least a developing unit, a laser scanning unit, a paper supply unit and the system of claim 11.

19. An image-forming apparatus comprising:

a developing unit;

a fusing unit;

a laser scanning unit;

a paper supply unit including a paper cartridge, and the system of claim 11, wherein the at least two RFID tags comprise a read/write RFID tag that records and provides information regarding an amount of toner remaining in the developing unit and/or a remaining life span of the developing unit, a read/write RFID tag that records and provides information regarding a remaining life span of the fusing unit, a read only RFID tag that provides stored prerecorded information regarding the laser scanning unit, and a read only RFID tag that is attached to the paper cartridge and provides prerecorded information regarding a type of the paper cartridge.

20. An image-forming apparatus comprising:

a developing unit;

a toner supply unit;

a laser scanning unit;

a paper supply unit including a paper cartridge and the system of claim 11, wherein the at least two RFID tags comprise a read/write RFID tag that records and provides information regarding the remaining life span of the developing unit, a read/write RFID tag that records and provides information regarding the amount of toner remaining in the toner supply unit, a read only RFID tag that provides stored prerecorded information regarding the laser scanning unit, and a read only RFID tag that is attached to the paper cartridge and provides prerecorded information regarding a type of the paper cartridge.

21. An image-forming apparatus comprising:

a developing unit;

a fusing unit;

a laser scanning unit;

a paper supply unit including a paper cartridge, and the system of claim 11, wherein the at least two RFID tags comprise a read/write RFID tag that records and provides information regarding an amount of toner remaining in the developing unit and/or a remaining life span of the developing unit, a read/write RFID tag that records and provides information regarding a remaining life span of the fusing unit, a read only RFID tag that provides stored prerecorded information regarding the laser scanning unit, a read only RFID tag that is attached to the paper cartridge and provides prerecorded information regarding a type of the paper cartridge and a read only RFID tag that provides information required for logistics management including at least one of a model name, a manufacturing date, a manufacturer, or a serial number of the image forming apparatus.

22. An image forming apparatus comprising:

at least two RFID tags, each RFID tag providing at least one of identification data or operational data of the image forming apparatus;

a single interrogator activating the RFID tags and receiving tag information of the RFID tags.

* * * * *

UNITED STATES PATENT AND TRADEMARK OFFICE

CERTIFICATE OF CORRECTION

PATENT NO. : 7,382,990 B2
APPLICATION NO. : 11/353950
DATED : June 3, 2008
INVENTOR(S) : Sang-cheol Park et al.

It is certified that error appears in the above-identified patent and that said Letters Patent is hereby corrected as shown below:

Column 6, line 36, change “1wherein” to --1 wherein--.

Column 6, line 45, change “main board” to --mainboard--.

Column 6, line 51, change “main board” to --mainboard--.

Signed and Sealed this

Fifth Day of August, 2008

JON W. DUDAS
*Director of the United States Patent and Trademark Office*